US007373754B2

(12) United States Patent
Albiero

(10) Patent No.: US 7,373,754 B2
(45) Date of Patent: May 20, 2008

(54) SAFETY EDGE FOR HORIZONTALLY PIVOTED ROLLING GATES

(75) Inventor: Francesco Albiero, Desenzano Del Garda (IT)

(73) Assignee: Stagnoli T.G. S.R.L., Brescia (IT)

( * ) Notice: Subject to any disclaimer, the term of this patent is extended or adjusted under 35 U.S.C. 154(b) by 629 days.

(21) Appl. No.: 10/792,604

(22) Filed: Mar. 3, 2004

(65) Prior Publication Data

US 2004/0194386 A1 Oct. 7, 2004

Related U.S. Application Data

(63) Continuation-in-part of application No. 10/093,315, filed on Mar. 7, 2002, now Pat. No. 6,851,222.

(30) Foreign Application Priority Data

Mar. 12, 2001 (IT) ..... BS2001A0019

(51) Int. Cl.
*E05F 15/02* (2006.01)

(52) U.S. Cl. ..... 49/27; 49/28; 200/61.43

(58) Field of Classification Search ..... 49/26, 49/27, 28; 200/61.43
See application file for complete search history.

(56) References Cited

U.S. PATENT DOCUMENTS 3,277,256 A * 10/1966 Jones ..... 200/61.43
5,148,911 A * 9/1992 Miller et al. ..... 200/61.43
5,345,671 A * 9/1994 Miller ..... 29/622
5,438,798 A * 8/1995 Plamper et al. ..... 49/28
5,481,076 A * 1/1996 Mullet et al. ..... 200/61.43
5,921,026 A * 7/1999 Miller ..... 49/27
5,962,825 A * 10/1999 Miller ..... 200/61.43
6,481,157 B1 * 11/2002 Haake et al. ..... 49/26
6,571,512 B1 * 6/2003 Miller et al. ..... 49/27
6,851,222 B2 * 2/2005 Albiero ..... 49/27

* cited by examiner

*Primary Examiner*—Jerry Redman
(74) *Attorney, Agent, or Firm*—McGlew and Tuttle P.C.

(57) ABSTRACT

A safety edge element made of flexible material includes a flat electric conductor, a rounded electric conductor as well as a first portion and a second portion. The first portion includes a base for the connection to a door or gate, a top with a seat to receive the flat electric conductor and two lateral sides to flexibly connect the base with the top. The base, top and lateral sides define a chamber. The second portion has a top and two lateral sides for the engagement with the top of the first portion and a seat arranged in the top of the second portion to receive the rounded electric conductor so that the rounded electric conductor is spaced from the flat electric conductor when the safety edge element is at rest and so that the rounded electric conductor is brought into contact with the flat conductor when the safety edge element experiences forces in orthogonal and inclined directions with respect to the base of the first portion.

24 Claims, 8 Drawing Sheets

SAFETY EDGE FOR HORIZONTALLY PIVOTED ROLLING GATES

CROSS REFERENCE TO RELATED APPLICATIONS

This application is a continuation-in-part of application Ser. No. 10/093,315 filed Mar. 7, 2002, now U.S. Pat. No. 6,851,222, (the entire contents of which are incorporated herein by reference) and which claims the benefit of priority under 35 U.S.C. § 119 of Italian patent application BS2001A000019 filed Mar. 12, 2001 (the entire contents of which are incorporated herein by reference).

FIELD OF THE INVENTION

The present finding relates to the field of horizontally pivoted rolling, gates and similar automated devices, and in particular, it relates to a safety edge applicable as safety means to such closing systems.

BACKGROUND OF THE INVENTION

The application of a so-called safety edge to horizontally pivoted rolling gates is already known. It consists of a rubber or soft material profile and a traction cable extending into the rubber profile and connecting to at least one microswitch, normally closed, inserted in the electrical circuit of the motor controlling the rolling gate. Since the edge is not stressed, the microswitch remains closed and the rolling gate is enabled to operate regularly. If, on the other hand, during the rolling gate movement, usually while closing, the edge detects or interferes with a foreign element that hinders its motion, the stressed cable causes the microswitch to open, thus opening the electrical circuit of the motor unit and stopping the rolling gate to prevent damages to people or things. In such safety edge, the cable essentially has the function of actuating means for the mechanical drive of a control to at least one microswitch. In another embodiment, a safety edge to be used on rolling gates uses laminations or crop ends of laminations s actuators, but always associated to current switches.

SUMMARY OF THE INVENTION

An object of the present invention is that of implementing and providing an improved safety edge for motor-driven rolling gates embedding electrical conductor means for its entire length, and acting at the same time, in any part of the edge, as means for stopping the rolling gate motor unit when the edge comes into contact with an obstacle, or is in any case stressed by a thrust.

Another object of the invention is that of providing a high-efficiency safety edge for rolling gates, easy to realize and convenient to be installed without having to use special angle joins when the edge is arranged on more sides of a rolling gate.

Such purposes are obtained, according to the present invention by a safety edge for motor-driven rolling gates consisting of a rubber profile, or made of another soft, flexible material, and of two electrical conductors extending longitudinally into said profile in parallel, normally separate from one another and movable closer to come into contact in the presence of a deforming thrust on said profile and enable an electrical circuit to send a signal for stopping the rolling gate motor unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE INVENTION

Figure 1:
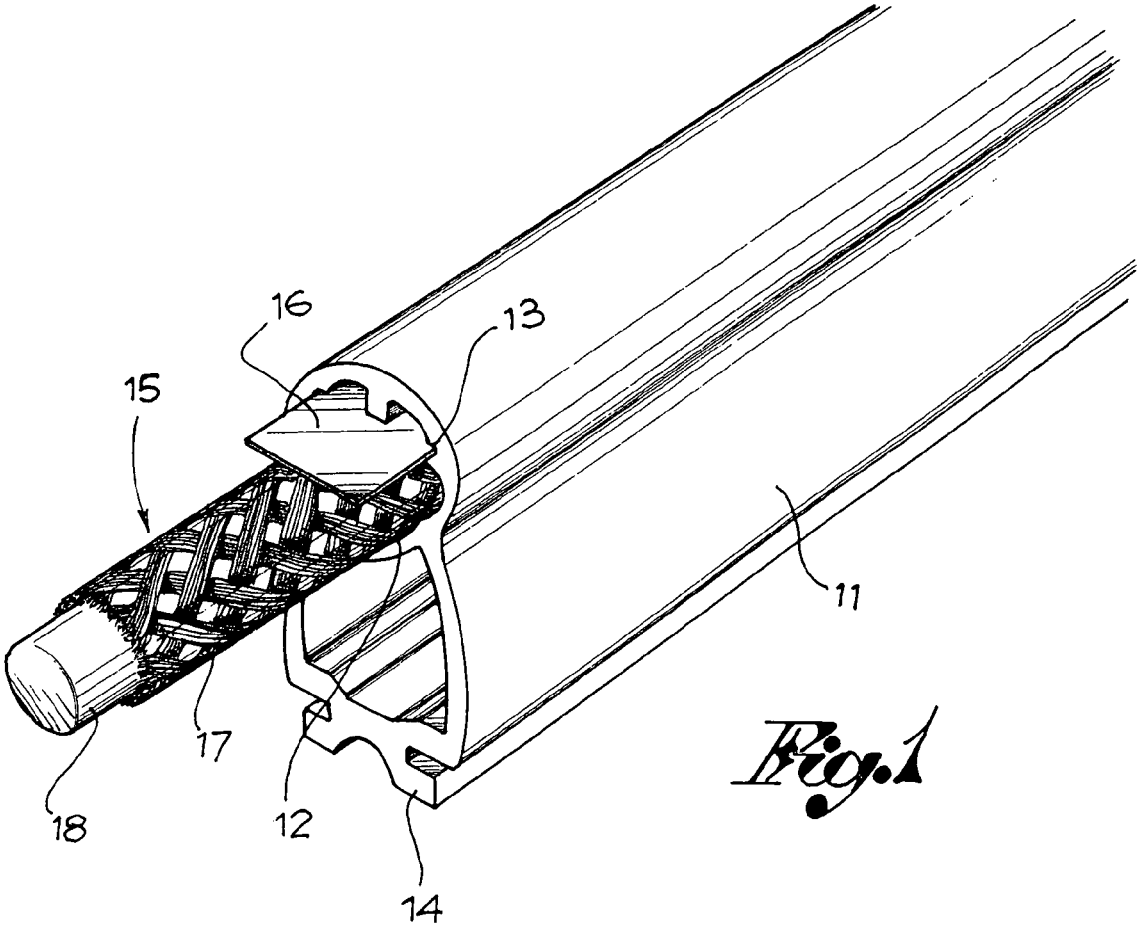
FIG. 1 is a perspective view of a crop end of safety edge.

The safety edge shown comprises a soft extruded profile 11 made of rubber or other flexible material, which longitudinally exhibits a first seat 12 and a second seat 13, shaped as channels, parallel and open the one towards the other. The first longitudinal seat 12 is closer to the base 14 of the profile than the second channel-shaped seat 13.

The first longitudinal seat 12 houses and holds a first electrical conductor 15, and the other longitudinal seat 13 houses a second electrical conductor 16. The two conductors 15, 16 extend for the entire length of profile 11, and the first of them preferably exhibits a round, half round, elliptical or similar section, whereas the second one preferably exhibits a flat section, such as in the shape of a tape, in any case flexible.

The first conductor 15 consists, for example, of a conductor braiding or mesh 17 arranged around an insulating core 18, and exposed towards the second flat conductor 16 with a rounded portion of its surface.

For the realization of the edge, the soft profile 11 can be extruded around one or both conductors, embedding them. Or, conductors 15, 16 can be inserted into the respective seats 12, 13 of the soft profile 11 after its extrusion. In any case, conductors 15,16 remain parallel and normally separate from one another when the safety edge is at rest.

Figure 3:
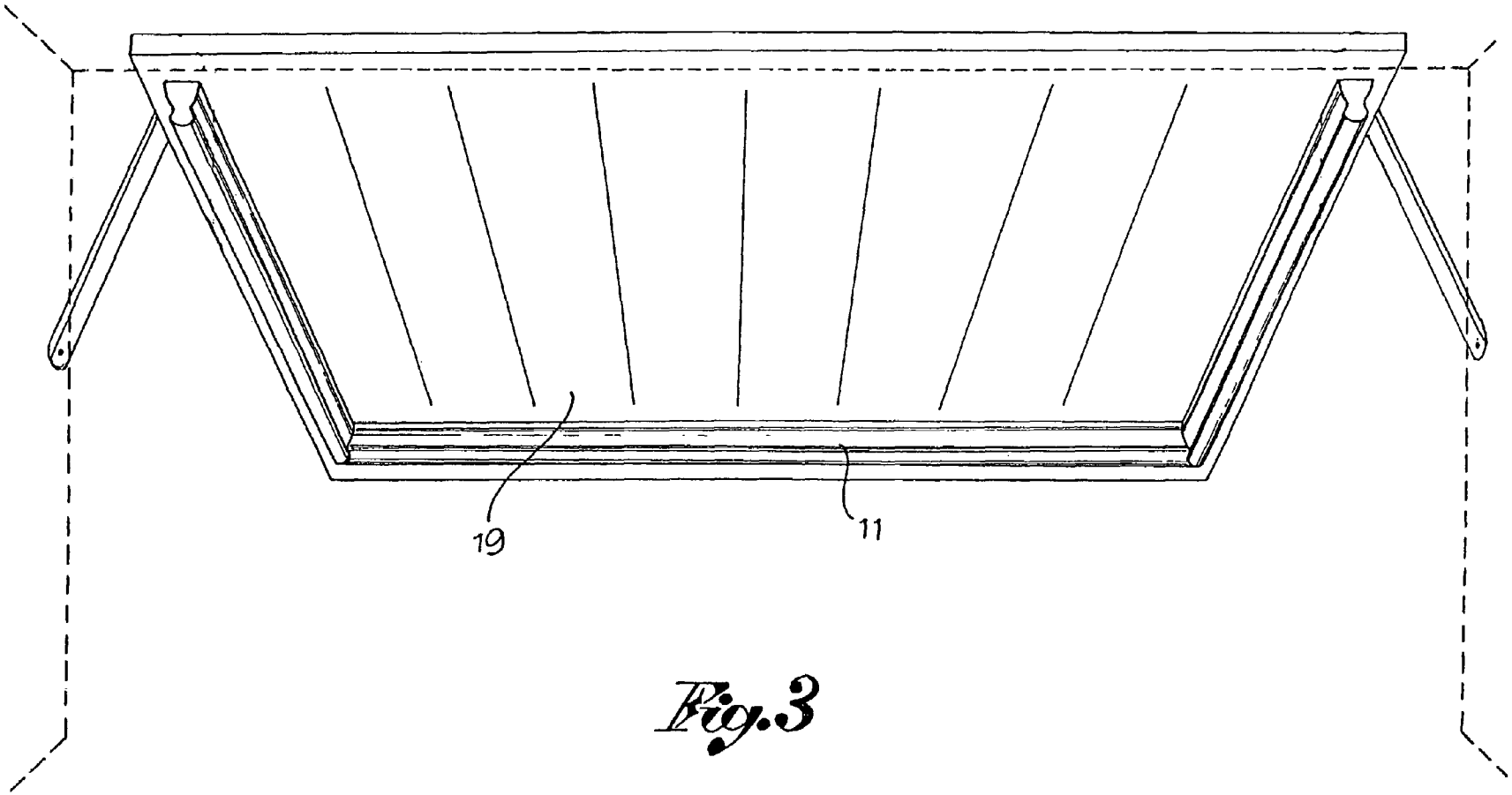
FIG. 3 is a perspective view of a garage door of the platform balance type.

The edge thus structured is applied with its base 14 to the edges of a horizontally pivoted rolling gate 19, as shown in FIG. 3, for example, and conveniently inserted through the conductors into the electrical circuit of the motor unit controlling the gate.

As long as the edge is at rest, since it is not stressed by external thrusts, the conductors remain separate and the rolling gate operates normally.

If during the rolling gate motion, any part of the edge meets an obstacle or a hindrance, so as to be stressed and compressed by an external source, the conductors close on one another, thus causing an immediate halt of the motor unit, and thereby of the rolling gate.

Given the shape and the association of the conductors, the safety edge trips in the presence of both orthogonal and inclined thrusts with respect to the profile base.

Figure 4:
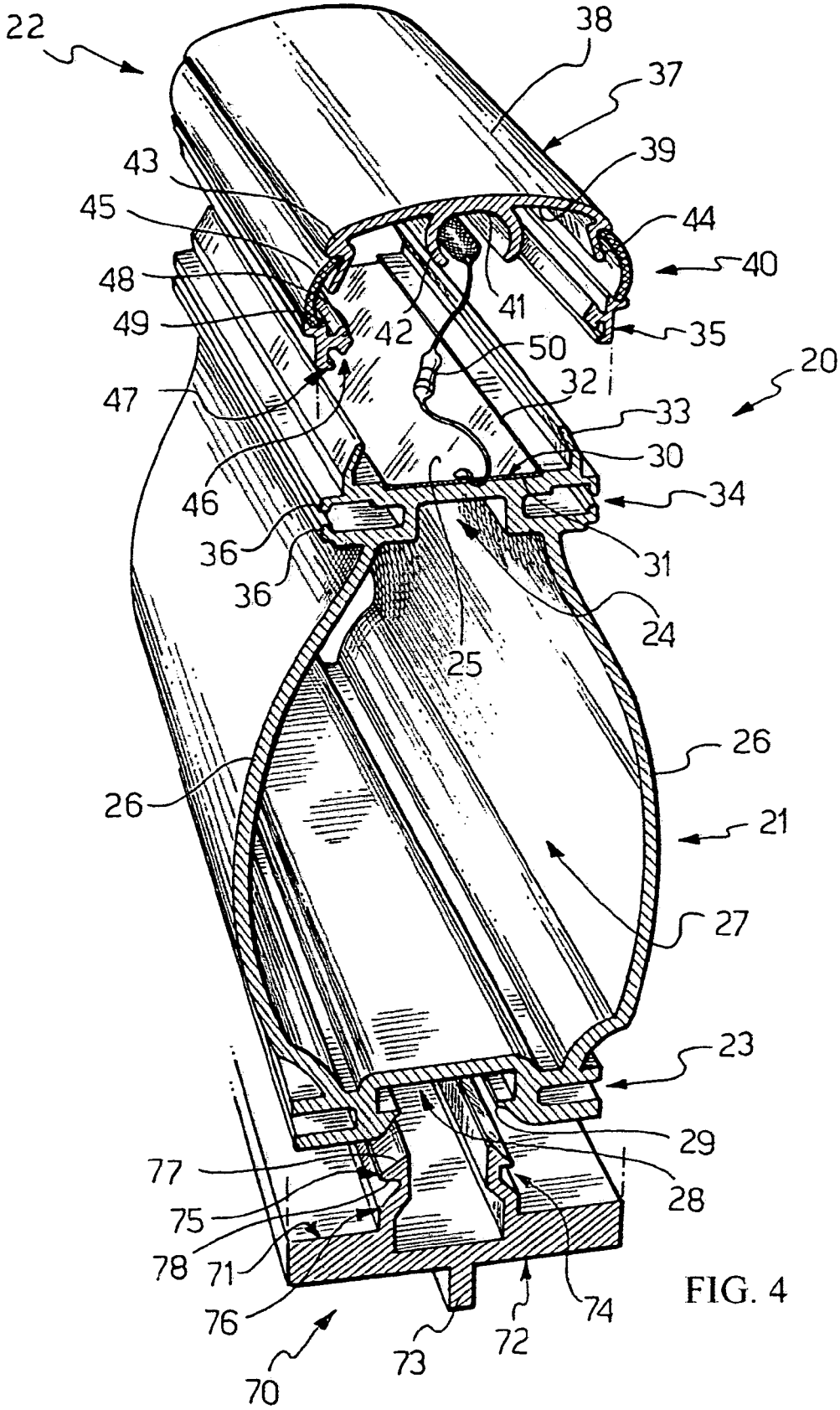
FIG. 4 is a perspective and exploded view of crop end of a safety edge according to a further embodiment of the present invention and a corresponding support frame.
Figure 5:
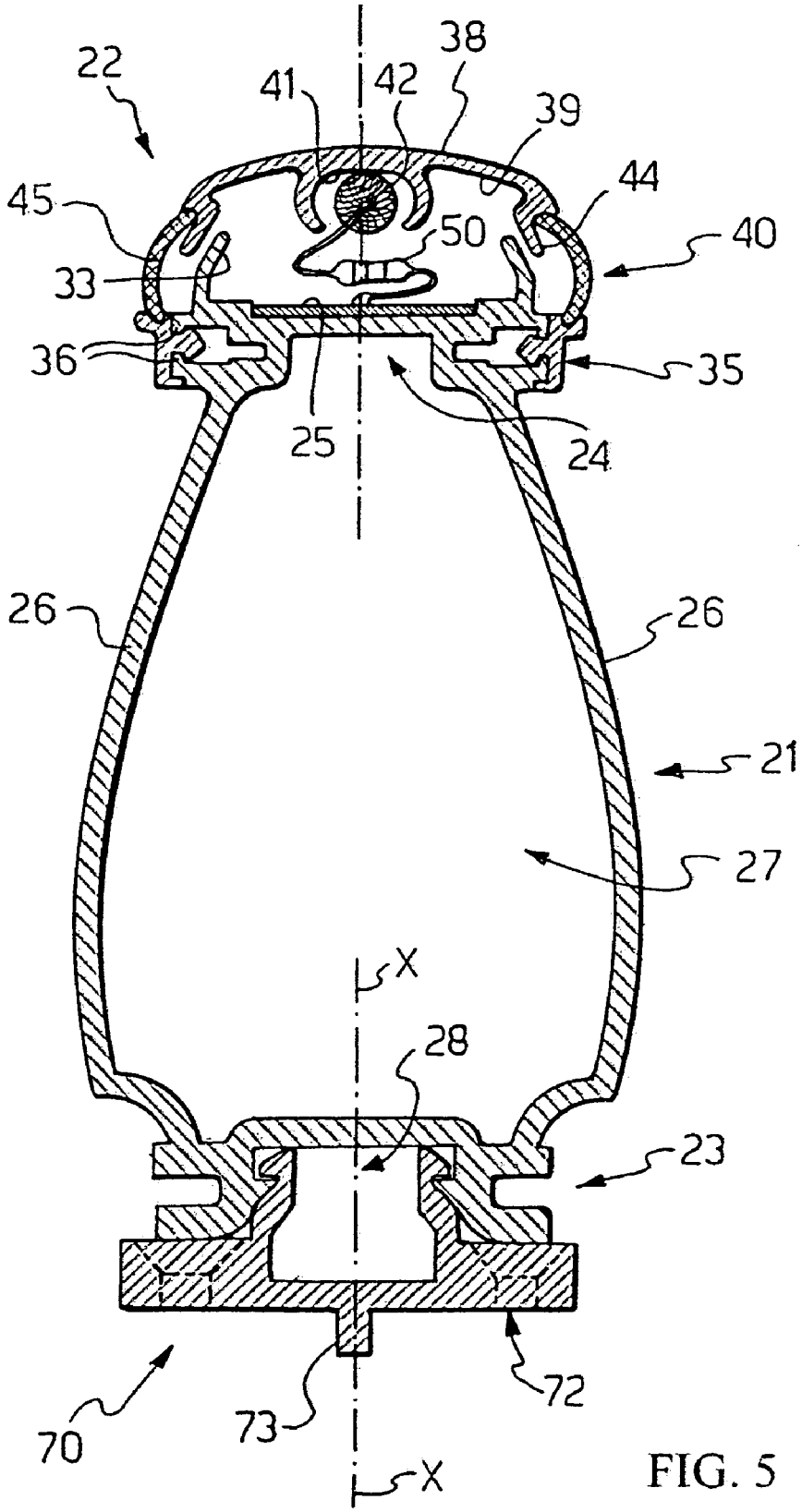
FIG. 5 is a transverse section of the safety edge of FIG. 4 in the assembled state.

In FIGS. 4 and 5, the number 20 identifies a longitudinally extending safety edge comprising a first portion 21 arid a second portion 22. The safety edge 20 is made of rubber or other flexible materials suitable to obtain soft extruded portions which retain elastic or flexible properties.

The first portion 21 comprises a base 23, adapted to be removably or not removably fixed to for instance a garage type door, as the one shown in FIG. 3, a top or crest 24 adapted to support a flat electrical, conductor 25 and two sides 26 flexibly connecting said base 23 to said top 24.

The base 23, the top 24 and the two sides 26 define a space or chamber 27. The chamber 27 preferably has a convex shape. In other words, each of the two sides 26 has an overall profile which is outwardly rounded. Furthermore, the base 23, the top 24 and the two sides 26 are formed in one piece according to FIG. 4, but as can be clearly understood by the skilled person in the art they can be formed in single pieces suitably connected, for instance by means of flap joints, or fixed, for instance by means of glue, in order to create a flexible or elastic structure.

The base 23 is provided with a seat 28 suitable to engage with a support frame as will be explained later. The seat 28 has two longitudinal teeth 29 which engage with corresponding undercuts of said support frame.

The top 24 comprises an outer surface 30 wherein a seat 31 to house and to removably hold the flat electrical conductor 25 is formed. In particular, the flat electrical conductor exhibits a substantially flat section, such as of a tape, in any case flexible. Consequently, the seat 31 can be provided with retaining means for retaining said flat electrical conductor 25 in said seat 31. Preferably, the retaining means are represented by taro longitudinal edges 32 extending over the surface of the seat in order to create two grooves suitable to engage with the corresponding longitudinal sides of said first electrical conductor.

It is to be noticed that the seat 31 is outwardly opened in order to allow the contact of the flat electrical conductor 25 with a rounded electrical conduct as will be explained later. Furthermore, two guide elements 33 extend from said surface 30 and cooperate with corresponding guide elements 44 of the second portion 22 as will be explained later. In particular, the guide elements are positioned laterally and longitudinally with respect to the flat electric conductor 25. Preferably, they are arc shaped towards the first conductor 25.

In addition, the top 24 is connected to the two sides 26 by means of two corresponding side elements 34. Preferably, said side elements 34 are a sort of releasable clamping means suitable to releasable retain corresponding connecting elements 35 of the second portion 22 which connect the top 24 of the first portion 21 of the edge 20, to the second portion 22 of the edge 20, as will be explained later. In particular, said releasable clamping means are each provided with a couple of free ends 36 inwardly curved to releasable retain said corresponding connecting elements 35.

The second portion 22 of the safety edge 20 comprises a top or perimeter 37, with an outer surface 38 and an inner surface 39, and two sides 40. The outer surface 38 is substantially smooth and slightly rounded. Instead, the inner surface 39 is provided with a seat 41 housing and releasable holding a rounded electrical conductor 42 so that said conductor faces the flat electrical conductor 25. The rounded electrical conductor 42 corresponds to the first conductor 25 disclosed above with reference to FIGS. 1 and 2.

The top 37 is provided with two longitudinal edges 43 each presenting a sort of flange 44 which creates a recess for connection with the corresponding sides 40. The flanges are bent towards the inner surface 39 of the second portion 22 slightly outwardly. The flanges 44 also function as guide elements which collaborate with the corresponding guide elements 33 of the top 24 of the first portion, 21 when a force is exercised on any point of the outer surface 37 in order to allow a correct contact between the flat electrical conductor 25 and the rounded electrical conductor 42.

The sides 40 comprise elastic elements 45, preferably represented by longitudinal elastic strips, and connecting elements 35. The elastic elements 45 elastically connect the top 37 to the connecting elements 35.

The connecting elements 35 comprises a first portion 46 suitable to engage with said releasable clamping means 34, a second portion 47 suitable to engage with the outer surface of one of said free ends 36. The first portion 46 comprises an head 48 having a conical shape and a stem 49 adapted to engage with said free ends 36.

Preferably, all the elements of the second portion 22 are extruded in a single piece which can releasable engage with the first portion 21 of the safety edge 20 just thanks to the clamping means 34 of the first portion 21 and the connecting elements 35 of the second portion 22.

Accordingly, the assemblage of the safety edge 20 simply consists in providing the first portion 21 and the second portion 22 separately extruded. Subsequently, the flat electric conductor 25 is inserted into its seat 31 in the first portion 21 and the rounded electric conductor 42 is inserted into the seat 41 of the second portion 22. Finally, the second portion 22 is mounted on the first portion 21 so that the connecting elements 35 engage with the clamping means 34.

Alternatively, the flat and rounded conductors are coextruded with the corresponding first and second portions, respectively, and thereafter mounted as explained above.

In the following description, the operation of the safety edge 20 will be explained.

When the safety edge 20 is at rest, the flat electrical conductor 27 and the rounded electrical conductor 42 are maintained separated one from the other for due to the elastic elements 45.

On the contrary, when for instance a garage type door or gate to which said safety edge 20 is applied is closing and something interposes between said closing door and the edges of the aperture of the garage, such as an arm of a person, a pushing force is applied to the outer surface 37 of the second portion 22. Said force causes the bending of the elastic strips 45 allowing the two electrical conductors 25 and 42 to come into contact. Said contact permits the sending of an electrical signal to the motor moving said door in order to stop its movement according to well known electric circuits.

However, this movement of the door does not immediately stop because, of the movement of inertia of the door itself.

Thanks to the above elastic chamber 27 a sufficient space is provided to allow the complete stop of the door taking into account of the movement of inertia without crushing for instance a person's arm. In other words, the elastic chamber can deaden the blow of the door or the crushing.

When the pushing force applied to the outer surface 37 of the second portion 22 is released, the second portion 22 returns in its initial resting position thanks to the return to the resting situation of the elastic strips 45. Consequently, the two electrical conductors 25 and 42 move away one from the other.

It is to be noticed that there are some additional advantages in the above described embodiment.

Figure 2:
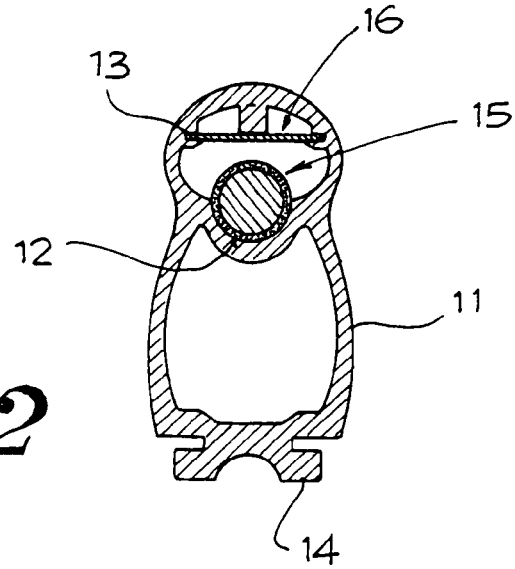
FIG. 2 is a transverse section of the safety edge.

First of all, the idea of inverting the position of the electrical conductors with respect to the embodiment of FIGS. 1 and 2 allows the production of the corresponding seats, and thus the entire safety edge, in a structurally simpler manner. In fact, as can be seen from the FIGS. 4 and 5, the seat 41 for the rounded electrical conductor 42 shows a very simple structure compared to the seat of the second conductor 16 of FIGS. 2 and 3. This permits the avoidance of possible problems which could occur during the extrusion or the co-extrusion of the safety profile due to the tolerance of the production process. Moreover, if the safety profile is extruded before, then the positioning of the electrical conductors into their corresponding seats occurs as a result very easily. In addition, the seat 31 for the flat electrical conductor 25 is a flat one, thus further simplifying the extrusion process of the safety edge and the positioning of the same electrical conductor in its seat.

A further advantage of the embodiment of FIG. 4 and 5 consists in an optimal stability of the flat electrical conductor and of the rounded electrical conductor. In fact, in particular following inclined pushes with respect to the outer surface 37 of the second portion 22, the two conductors are prevented form escaping from their respective seats due to the construction. Consequently, both bending and/or undesired contacts are avoided, too. Thus, the reliability of the functioning of the safety edge can be improved.

According to a further embodiment of the present invention, the safety edge 20 can comprise a resistor 50 electrically connected between the flat electrical conductor 25 and the rounded electrical conductor 42 having a predetermined resistance. Such a resistor 50 is placed at the ends of respectively said flat electrical conductor 25 and the rounded electrical conductor 42, as shown in FIG. 4. Furthermore, the resistor 50 should be an element allowing for the detection of a change in the electrical signal caused by a break along one or both the two electric conductors. In this manner, advantageously the reliability of the safety edge can be further improved at the same time maintaining the main function of the system. In fact, the system so designed allows the detection of a first status which corresponds to the rest of the two electrical conductors so that the overall circuit provides a maximum resistance, a second status which corresponds to the contact of said electrical conductors so that the overall circuit is resultingly closed and the resistance detected is minimum and a further status which corresponds to an interruption on the electrical conductors so that the resistance detected has an infinite value.

The safety edge according to the present invention can be produced in a single extruded piece made of rubber or other polymers which have elastic or flexible properties in order to operate as explained.

However, the safety edge can be produced in different portions or pieces, as for the embodiment of FIGS. 4 and 5, each with different elastic or flexible materials in order to adapt to specific functions. For instance, the top 37 of the second portion 22 can be made of a relative rigid rubber since it has to tolerate crushes without deforming, while the elastic strips 45 should be made of a more elastic material in order to function as a sort of spring. The first portion 21 could also be made of a relative elastic material in order to be bent for a height so as to overcome the above explained movement of inertia. Similar adaptations can be made in connection with the safety edge described with reference to FIGS. 2 and 3.

In any case, the advantage of having a second portion comprising a first electric conductor, elastic elements and connecting elements and a first portion comprising a second electric conductor formed separated but operatively associated as explained above consists in improving the sensibility of the system. In fact, two releasable independent pieces so joined, each carrying one conductor, permit the release of reciprocal movements with the result of being more reactive to a pressure exerted on any point onto the outer surface of the second portion of the safety edge.

With reference to FIG. 4 and 5 and according to a further embodiment, the reference number 70 identifies a support frame which can be applied to any kind of structure according the invention in order to improve the assembly or disassembly of the above safety edge. In fact, the safety edge element of the invention can be directly applied to a door or gate or can be applied by means of the interposition of the support frame.

In particular, the support frame 70 shows a first surface 71 and a second surface 72. The second surface 72 is adapted to be fixed for instance to a garage door. In FIG. 5, preferably, the second surface 72 is substantially flat and is provided with a projection 73 positioned in the middle of the surface along an axis X-X perpendicular to the same surface. The projection 73 functions as blocking means for blocking the support frame on a garage type door through a corresponding groove (not shown).

Two flexible wings 74 protrude from the first surface 71 and have a head 75 and a stern 76. The head 75 is designed in order to have a first surface 77 inclined with respect to the axis X-X and a second surface 78 towards and substantially parallel to said surface. In particular, said second surface 78 creates an undercut which engages with the teeth 29 of the base 23 of the safety profile 20.

When the safety edge 20 is to be mounted on for instance a garage type door, the safety edge 20 can be positioned so that the teeth 29 of its base match the heads 74 of the support frame 70 fixed on said door. Subsequently, it is sufficient to slide the safety edge along the support frame. Alternatively, thanks to the flexibility of the wings 74, the safety edge 20 can be pushed on the support frame 70 until the teeth 29 engage with the heads 74.

In addition, the support frame 70 can be represented by short pieces positioned at predetermined distances along the safety edge.

It is to be noticed that the above support frame can be also suitable for supporting the safety edge according to FIG. 1 and 2 provided that the base of the safety edge is modified according to FIGS. 4 and 5.

The safety edge of the invention can be applied to several structures which in general involve situations wherein a crush between a movable part and a fixed part can happen.

Figure 6:
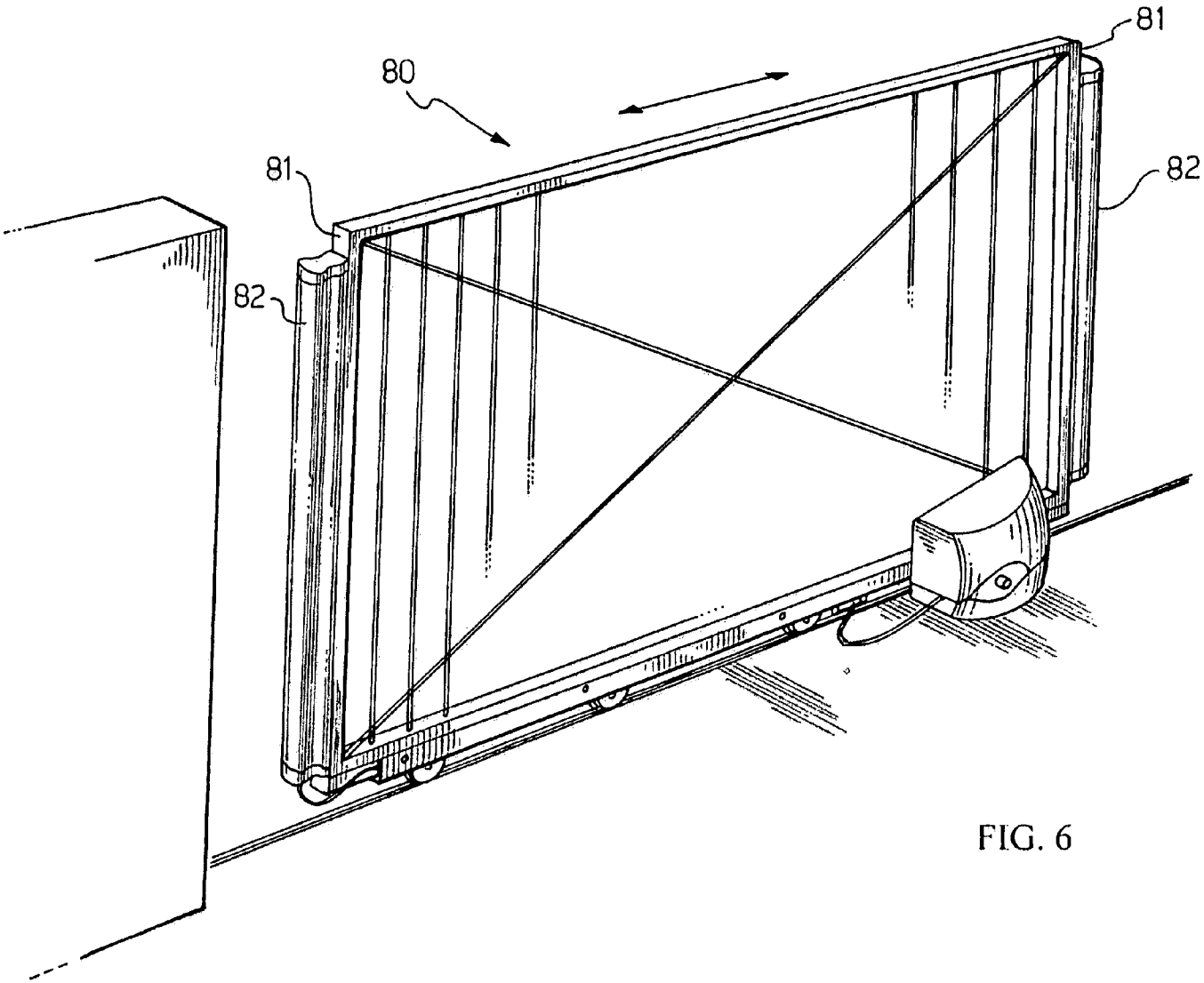
FIG. 6 is a perspective view of a sliding gate with the safety edge of FIG. 4.
Figure 7:
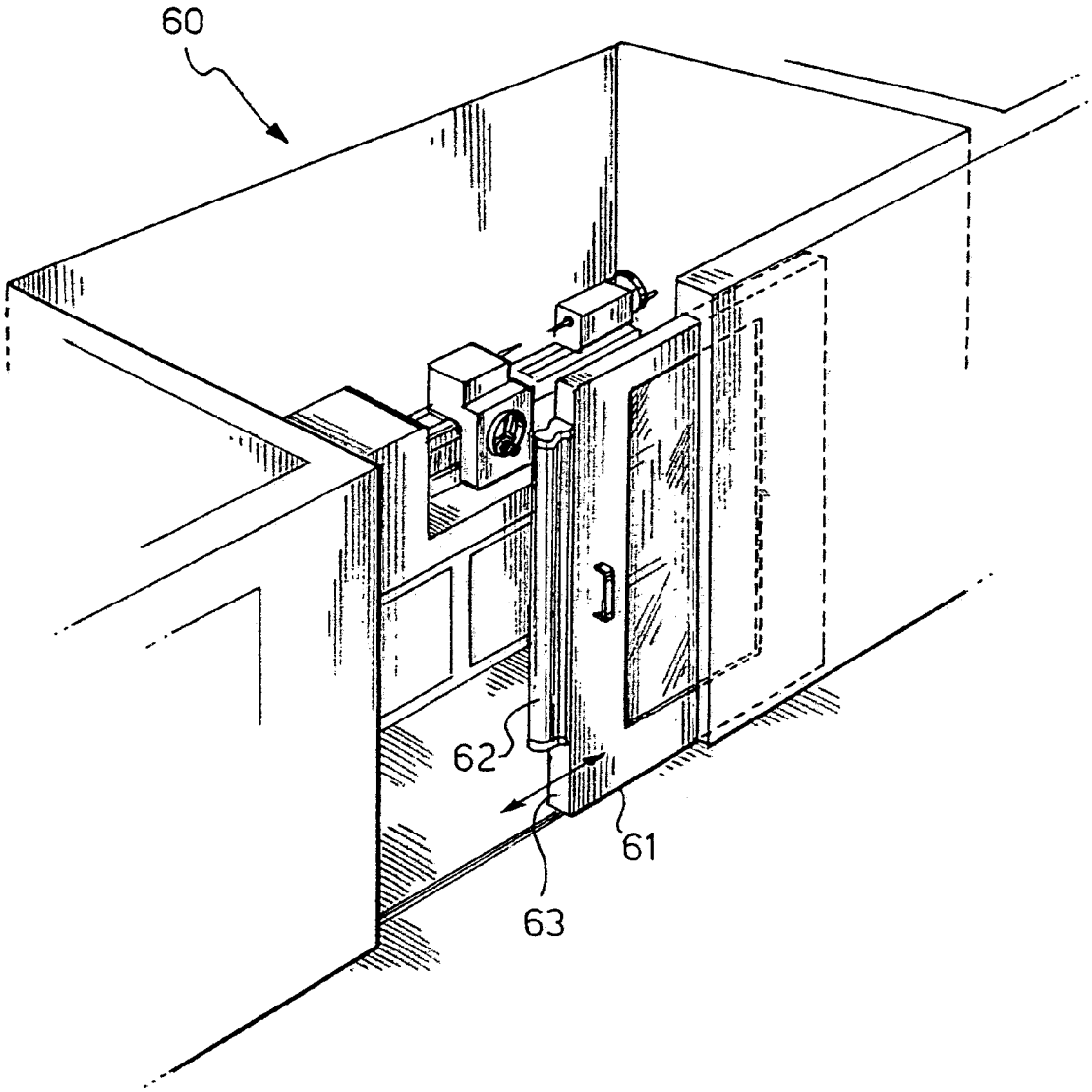
FIG. 7 is a perspective view of a sliding door of a schematically represented machine tool with the safety edge of FIG. 4.

With reference to FIGS. 6 and 7, there is represented different applications of the safety edge as disclosed with reference to FIG. 3, even if all such applications are to be intended only as non limiting examples.

In particular, in FIG. 6 a sliding gate 80 is schematically shown. The sliding door 80 is any of the well known sliding gates available on the market and comprises at least two lateral sides 81 suitably to close the entry in a delimited open or closed space such as for instance a courtyard. These lateral sides 81 are provided with the safety edge 82 according to any one of the above described embodiments.

In FIG. 7, a schematic view of a machine tool 60 comprising a movable door 61 provided with a safety edge 62 of the present invention is shown. The safety edge 62 is mounted on the closing side 63 of said door 61. In this case, the safety edge 62 can be connected to the machine tool so that its function is prevented when the safety edge 62 detects the presence of an interference between its contact surface and the closing side 64 of the machine tool such as the arm of an operator or a tool inadvertently left between the inner side and the out side of the machine tool. Such machine tool 60 can be for instance a numerical control machine as provided with a press, a lathe etc.

Figure 8:
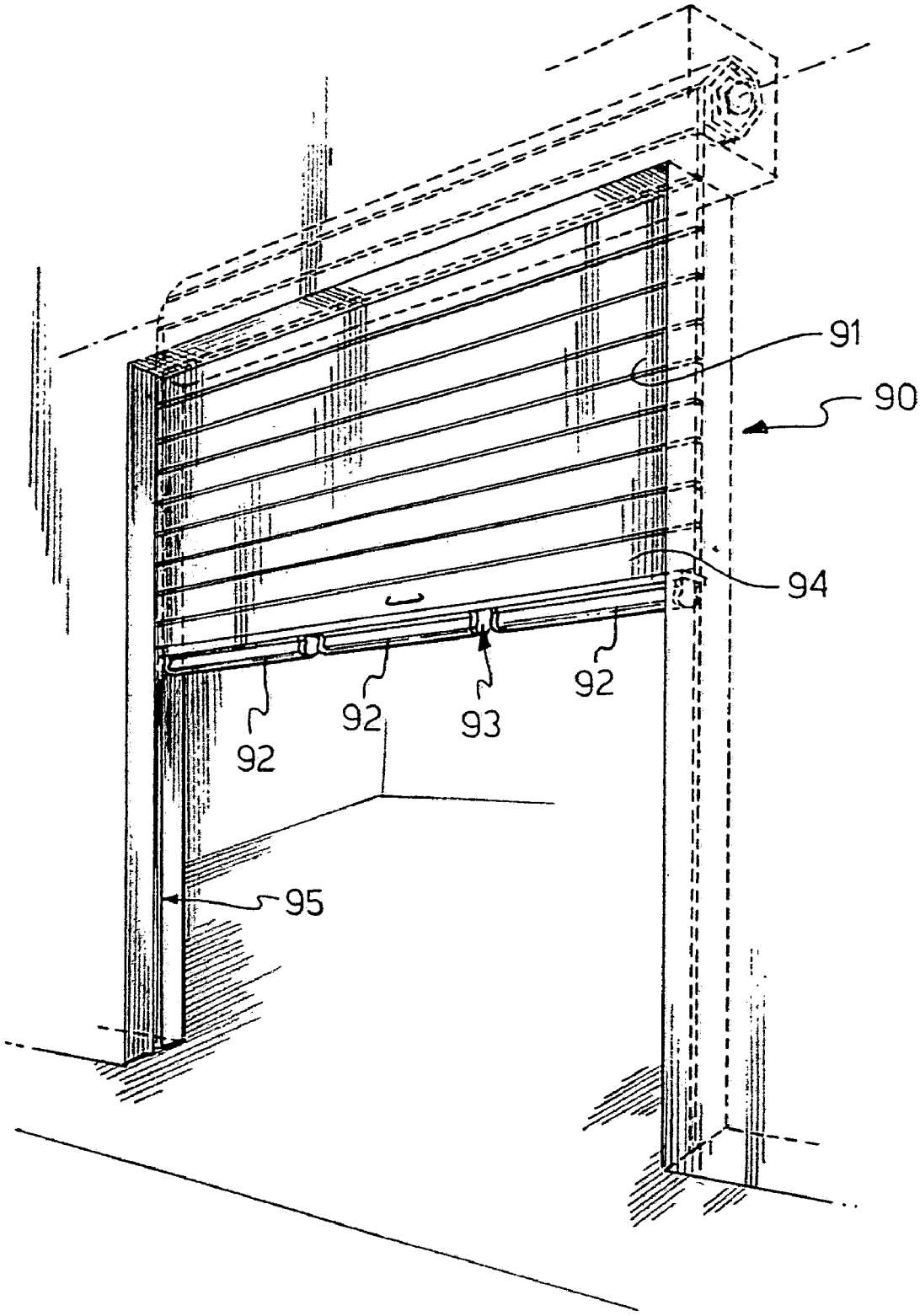
FIG. 8 is a perspective view of a garage door of the rolling gate type.

With reference to the garage, doors, it is to be noticed that in the present invention said term comprises other garage doors with respect to those above described. For instance, FIG. 8 shows a garage door 90 of the rolling type with a plurality of pivoting sections 91 or sections which are articulated to each other. With the articulations the door may move along a guide 95. All of the sections are generally horizontally disposed in an open position and the sections are generally vertically disposed an a closed position. In this case, the safety edge 92 of the invention can be provided along the free side 93 of the lower section 94 which conies into contact with the ground to close the garage.

Figure 9:
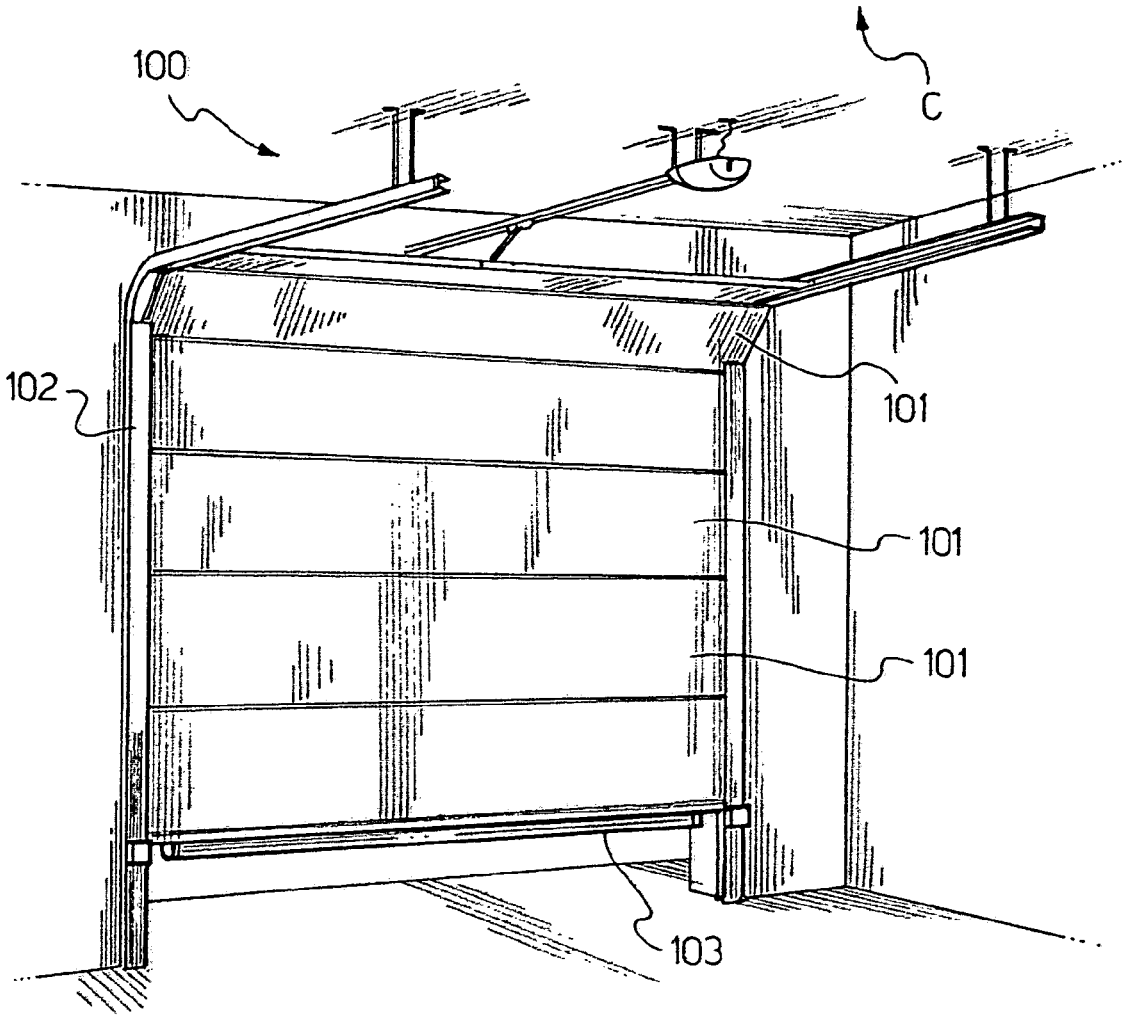
FIG. 9 is a perspective view of a garage door of the sectional gate type.

FIG. 9 shows a garage door 100 of the sectional gate type similar to the one represented in FIG. 8. However, in the present embodiment the plurality of sections 101 move along two lateral guides 102 which extend over the ceiling C of the garage so that these sections can horizontally run parallel to the ceiling C. As above, the lower section of the door is provided at its free side with the safety edge 103 according to any one of the preceding embodiments.

While specific embodiments of the invention have been shown and described in illustrate the application of the principles of the invention, it will be understood that the invention may be embodied otherwise without departing from such principles.

What is claimed is:

1. A safety edge element made of flexible material, the safety element comprising:

a flat electric conductor;

a rounded electric conductor;

a first portion comprising a base for the connection to a door or gate, a top with a seat to receive said flat electric conductor and two lateral sides to flexibly connect said base with said top, said base, top and lateral sides defining a chamber;

a second portion comprising a top and two lateral sides for the engagement with said top of said first portion and a seat arranged in said top of said second portion to receive said rounded electric conductor so that said rounded electric conductor is spaced from said flat electric conductor when the safety edge element is at rest and so that said rounded electric conductor is brought into contact with said flat conductor when the safety edge element experiences forces in orthogonal and inclined directions with respect to said base of said first portion, wherein said top of said first portion has an outer surface defining said seat to house and removably hold said flat electric conductor and wherein a guide element extends from said outer surface.

2. A safety edge element according to claim 1, wherein said base of said first portion comprises a seat suitable to engage with a support frame.

3. A safety edge element according to claim 2, wherein said seat of said base comprises two longitudinal teeth which engage with corresponding undercuts of said support frame.

4. A safety edge element according to claim 1, wherein said seat is provided with retaining means for retaining said flat electric conductor.

5. A safety edge element according to claim 1, wherein said lateral sides are connected to said first portion by means of two corresponding side elements.

6. A safety edge element according to claim 1, wherein said top of said second portion comprises an outer surface and an inner surface, said inner surface being provided with a seat for housing and releasable holding said rounded electric conductor.

7. A safety edge element according to claim 1, wherein said top of said second portion comprises two longitudinal edges functioning as guide elements.

8. A safety edge element according to claim 1, wherein said lateral sides of said second portion comprises elastic elements and connecting elements.

9. A safety edge element according to claim 8, wherein said elastic elements are longitudinal elastic strips.

10. A safety edge element according to claim 8, wherein said connecting elements comprise a first connecting element portion suitable to engage with clamping means of a first portion of said safety edge and a connecting element second portion suitable to engage with said outer surface of one of said clamping means.

11. A safety edge element according to claim 8, wherein said elastic elements are made with an elastomer.

12. A safety edge element according to claim 1, wherein said first and second portions of the safety edge are each coextruded with said flat and rounded conductors.

13. A safety edge element according to claim 1, further comprising a resistor to detect a change in the electrical signal caused by a break along one or both said flat and rounded electric conductors.

14. A safety edge element according to claim 1, comprising a support frame suitable for removably supporting the safety edge element on a door or gate.

15. A safety edge element according to claim 14, wherein said support frame comprises a first surface for releasably connecting the safety edge element and a second surface for blocking said support frame on a door or gate.

16. A safety edge element according to claim 15, wherein said second surface comprises a projection functioning as a blocking means for blocking said support frame on a door or gate.

17. A safety edge element according to claim 15, wherein said first surface comprises two flexible longitudinal wings for releasable engaging with said base of said safety edge element.

18. A safety edge element according to claim 1, in combination with a sliding door.

19. A safety edge element according to claim 1, in combination with a sliding gate.

20. A combination according to claim 19, wherein said gate comprises at least two lateral sides suitable to close the entry in a limited open or closed space, said lateral sides being provided with the safety edge.

21. A safety edge element according to claim 1, in combination with a sectional type door.

22. A safety edge element made of flexible material, the safety element comprising:

a flat electric conductor;

a rounded electric conductor;

a first portion comprising a base for the connection to a door or gate, a top with a seat to receive said flat electric conductor and two lateral sides to flexibly connect said base with said top, said base, top and lateral sides defining a chamber;

a second portion comprising a top and two lateral sides for the engagement with said top of said first portion and a seat arranged in said top of said second portion to receive said rounded electric conductor so that said rounded electric conductor is spaced from said flat electric conductor when the safety edge element is at rest and so that said rounded electric conductor is brought into contact with said flat conductor when the safety edge element experiences forces in orthogonal and inclined directions with respect to said base of said first portion, wherein said lateral sides are connected to said first portion by means of two corresponding side elements and wherein said side elements are releasable clamping means.

23. A safety edge element according to claim 22, wherein said top of said first portion has an outer surface defining said seat to house and removably hold said flat electric conductor.

24. A safety edge element according to claim 23, wherein a guide elements extends from said outer surface.

* * * * *